US011401700B2

(12) United States Patent
Chikugo et al.

(10) Patent No.: US 11,401,700 B2
(45) Date of Patent: Aug. 2, 2022

(54) HYDRAULIC OIL MONITORING SYSTEM AND HYDRAULIC OIL MONITORING METHOD

(71) Applicant: Komatsu Ltd., Tokyo (JP)

(72) Inventors: Hiroyuki Chikugo, Tokyo (JP); Shuuji Hori, Tokyo (JP); Haruna Higashi, Tokyo (JP)

(73) Assignee: Komatsu Ltd., Tokyo (JP)

( * ) Notice: Subject to any disclaimer, the term of this patent is extended or adjusted under 35 U.S.C. 154(b) by 190 days.

(21) Appl. No.: 16/958,312

(22) PCT Filed: Apr. 3, 2019

(86) PCT No.: PCT/JP2019/014894
§ 371 (c)(1),
(2) Date: Jun. 26, 2020

(87) PCT Pub. No.: WO2019/202998
PCT Pub. Date: Oct. 24, 2019

(65) Prior Publication Data

US 2021/0062476 A1 Mar. 4, 2021

(30) Foreign Application Priority Data

Apr. 16, 2018 (JP) ..... JP2018-078594

(51) Int. Cl.
*E02F 9/26* (2006.01)
*E02F 9/08* (2006.01)
*E02F 9/22* (2006.01)

(52) U.S. Cl.
CPC ..... *E02F 9/267* (2013.01); *E02F 9/0883* (2013.01); *E02F 9/226* (2013.01)

(58) Field of Classification Search
CPC ..... E02F 9/0883; E02F 9/226; E02F 9/267; F15B 1/26; F15B 21/044
See application file for complete search history.

(56) References Cited

U.S. PATENT DOCUMENTS

| | | | |
|---|---|---|---|
| 8,812,267 | B2 | 8/2014 | Satake |
| 9,522,538 | B2 | 12/2016 | Kuri |
| 9,836,839 | B2 | 12/2017 | Champlin et al. |
| 10,258,909 | B2 | 4/2019 | Miyasaka |
| 10,385,545 | B2 | 8/2019 | Kamoshita et al. |
| 10,900,201 | B2 | 1/2021 | Shintani et al. |
| 11,047,112 | B2 | 6/2021 | Jimbo et al. |

(Continued)

FOREIGN PATENT DOCUMENTS

| | | | |
|---|---|---|---|
| CN | 1440832 | A | 9/2003 |
| CN | 1614162 | A | 5/2005 |

(Continued)

OTHER PUBLICATIONS

International Search Report dated Jun. 25, 2019, issued for PCT/JP2019/014894.

*Primary Examiner* — Michael Leslie
*Assistant Examiner* — Daniel S Collins
(74) *Attorney, Agent, or Firm* — Locke Lord LLP

(57) ABSTRACT

A hydraulic oil monitoring system includes an image-data acquiring unit that acquires image data of the oil surface of hydraulic oil stored in a hydraulic oil tank of a work vehicle and an image analyzing unit that outputs, based on the image data, air bubble data relating to air bubbles included in the hydraulic oil.

9 Claims, 9 Drawing Sheets

(56) References Cited

U.S. PATENT DOCUMENTS

| | | | | |
|---|---|---|---|---|
| 2003/0155015 | A1* | 8/2003 | Dudra | B60T 11/26 137/558 |
| 2011/0153275 | A1 | 6/2011 | Satake | |
| 2014/0238923 | A1 | 8/2014 | Miyasaka | |
| 2016/0263895 | A1 | 9/2016 | Kuri | |
| 2016/0350914 | A1 | 12/2016 | Champlin et al. | |
| 2018/0030692 | A1 | 2/2018 | Kamoshita et al. | |
| 2018/0094408 | A1 | 4/2018 | Shintani et al. | |
| 2018/0245490 | A1 | 8/2018 | Hori et al. | |
| 2019/0032306 | A1 | 1/2019 | Jimbo et al. | |
| 2020/0232911 | A1* | 7/2020 | Chikugo | F01M 11/10 |

FOREIGN PATENT DOCUMENTS

| | | | |
|---|---|---|---|
| CN | 102645456 | A | 8/2012 |
| CN | 103792869 | A | 5/2014 |
| CN | 104160096 | A | 11/2014 |
| CN | 204347022 | U | 5/2015 |
| CN | 204961432 | U | 1/2016 |
| CN | 105946361 | A | 9/2016 |
| CN | 106661871 | A | 5/2017 |
| CN | 106988357 | A | 7/2017 |
| CN | 107076555 | A | 8/2017 |
| CN | 206387440 | U | 8/2017 |
| CN | 107646115 | A | 1/2018 |
| CN | 107660257 | A | 2/2018 |
| CN | 207231881 | U | 4/2018 |
| GB | 2273989 | A | 7/1994 |
| GB | 2275534 | A | 8/1994 |
| JP | H09-004602 | A | 1/1997 |
| JP | 2010-007782 | A | 1/2010 |
| JP | 2010038054 | A | 2/2010 |
| JP | 2013-117169 | A | 6/2013 |
| WO | 2017/073734 | A1 | 5/2017 |
| WO | 2018/198498 | A1 | 11/2018 |

* cited by examiner

FIG.7

| PATTERN OF CAUSE OF OCCURRENCE OF AIR BUBBLES | PATTERN OF TREATMENT METHOD FOR SUPPRESSING OCCURRENCE OF AIR BUBBLES |
|---|---|
| QUANTITY OF HYDRAULIC OIL IS EQUAL TO OR SMALLER THAN OIL QUANTITY THRESHOLD | SUPPLY OIL TO HYDRAULIC OIL TANK |
| INCLINATION ANGLE IS EQUAL TO OR LARGER THAN INCLINATION ANGLE THRESHOLD OR CHANGE RATE OF INCLINATION ANGLE IS EQUAL TO OR LARGER THAN CHANGE RATE THRESHOLD | NOT USE WORK VEHICLE IN PLACE WHERE INCLINATION IS LARGE |
| ACCELERATION IS EQUAL TO OR LARGER THAN ACCELERATION THRESHOLD | REDUCE ACCELERATION |
| BREAKAGE | REPAIR HYDRAULIC OIL TANK OR REPLACE COMPONENTS |

FIG.8

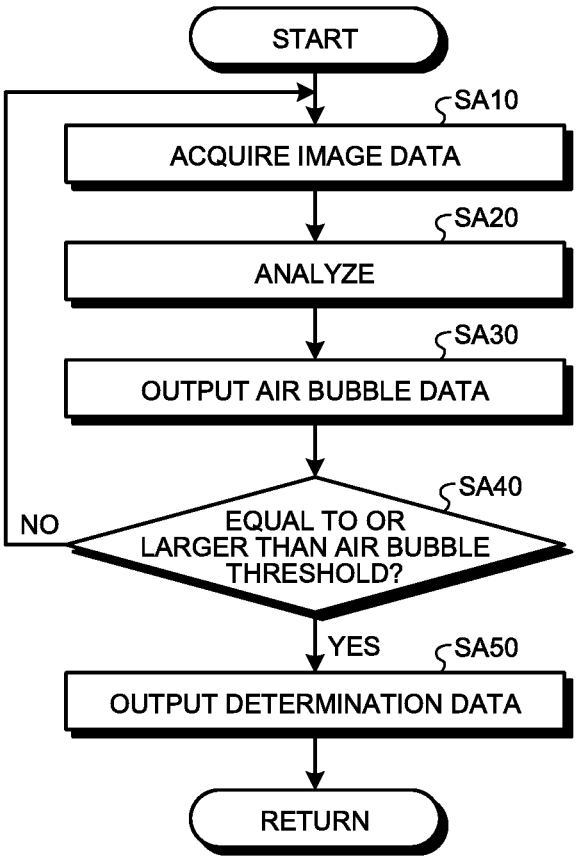

HYDRAULIC OIL MONITORING SYSTEM AND HYDRAULIC OIL MONITORING METHOD

FIELD

The present invention relates to a hydraulic oil monitoring system and a hydraulic oil monitoring method.

BACKGROUND

In a work vehicle including a hydraulic actuator, the hydraulic actuator operates based on hydraulic oil supplied from a hydraulic pump. The hydraulic pump sucks the hydraulic oil stored in a hydraulic oil tank.

CITATION LIST

Patent Literature

Patent Literature 1: JP 09-004602 A

SUMMARY

Technical Problem

When air bubbles occur in the hydraulic oil stored in the hydraulic oil tank, the hydraulic pump is likely to be broken. Therefore, it is necessary to quantitatively or qualitatively monitor the air bubbles included in the hydraulic oil and take measures for suppressing the occurrence of the air bubbles.

An object of an aspect of the present invention is to quantitatively or qualitatively monitor air bubbles included in hydraulic oil.

Solution to Problem

According to an aspect of the present invention, a hydraulic oil monitoring system, comprises: an image-data acquiring unit that acquires image data of an oil surface of hydraulic oil stored in a hydraulic oil tank of a work vehicle; and an image analyzing unit that outputs, based on the image data, air bubble data relating to air bubbles included in the hydraulic oil.

Advantageous Effects of Invention

According to the aspect of the present invention, it is possible to quantitatively or qualitatively monitor air bubbles included in hydraulic oil.

BRIEF DESCRIPTION OF DRAWINGS

FIG. 7 is a schematic diagram illustrating an example of a treatment storing unit according to the embodiment.

FIG. 8 is a flowchart illustrating an example of a hydraulic oil monitoring method according to the embodiment.

DESCRIPTION OF EMBODIMENTS

An embodiment according to the present invention is explained below with reference to the drawings. However, the present invention is not limited to this. Constituent elements of the embodiment explained below can be combined as appropriate. A part of the constituent elements is sometimes not used.

[Work Vehicle]

Figure 1:
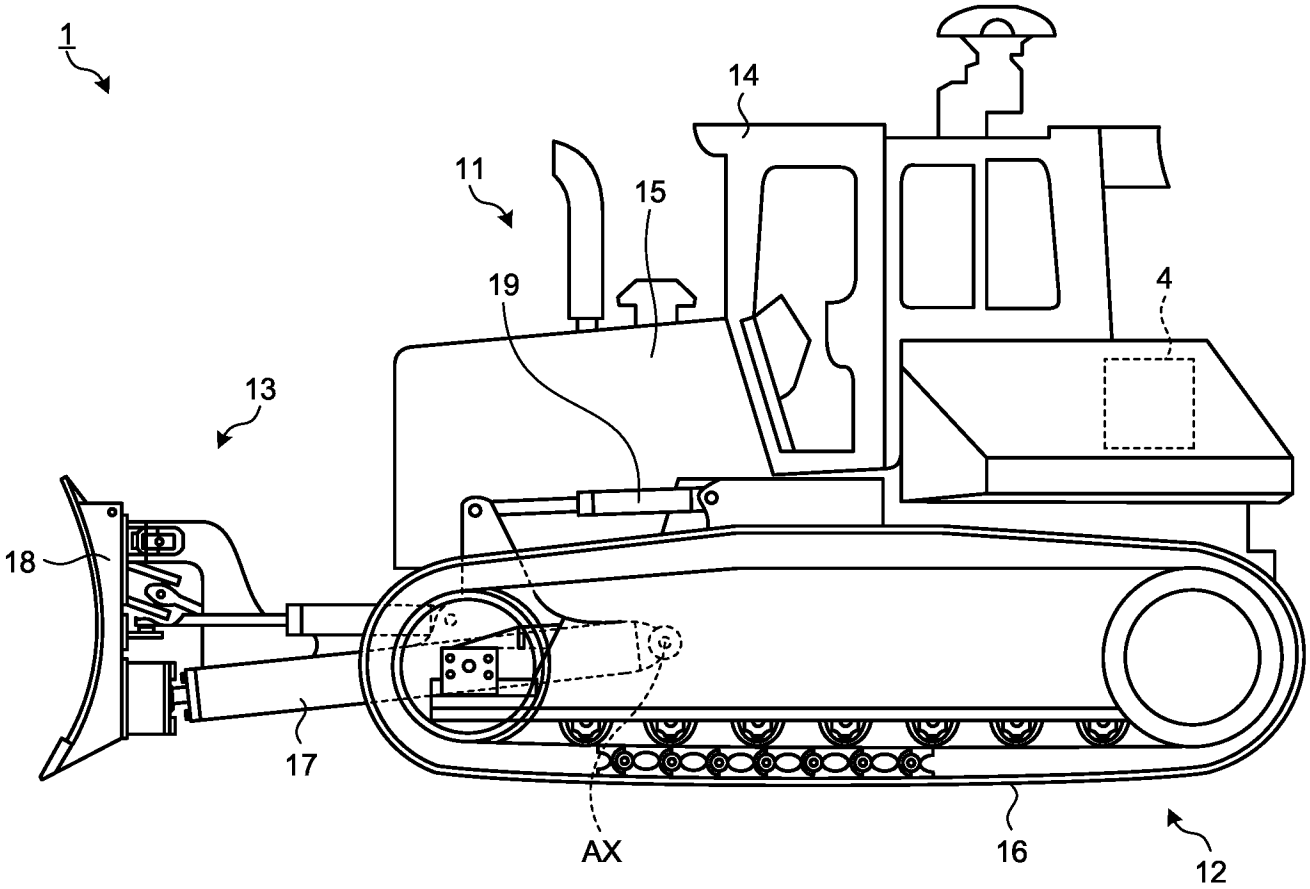
FIG. 1 is a diagram illustrating an example of a work vehicle according to an embodiment.

FIG. 1 is a diagram illustrating an example of a work vehicle 1 according to this embodiment. The work vehicle 1 is mounted with hydraulic equipment. As the work vehicle 1, at least one of a bulldozer, an excavator, a wheel loader, and a dump truck is illustrated. In this embodiment, it is assumed that the work vehicle 1 is a bulldozer. The work vehicle 1 includes a vehicle body 11, traveling equipment 12, and working equipment 13.

The vehicle body 11 includes a driver's cab 14 and an engine compartment 15. A driver's seat is disposed in the driver's cab 14. The engine compartment 15 is disposed in front of the driver's cab 14.

The traveling equipment 12 is attached to a lower part of the vehicle body 11. The traveling equipment 12 includes a pair of left and right crawler belts 16. The crawler belts 16 rotate, whereby the work vehicle 1 travels. The traveling of the work vehicle 1 may be any traveling such as manned, unmanned, remote controlled, and automatic driving.

The working equipment 13 is attached to the vehicle body 11. The working equipment 13 includes a lift frame 17, a blade 18, and a lift cylinder 19.

The lift frame 17 is attached to the vehicle body 11 to be capable of rotating in an up-down direction around a rotation axis AX extending in a vehicle width direction. The lift frame 17 supports the blade 18. The blade 18 is disposed in front of the vehicle body 11. The blade 18 moves in the up-down direction in association with the lift frame 17.

The lift cylinder 19 is coupled to each of the vehicle body 11 and the lift frame 17. The lift cylinder 19 extends and contracts, whereby the lift frame 17 rotates in the up-down direction around the rotation axis AX.

Figure 2:
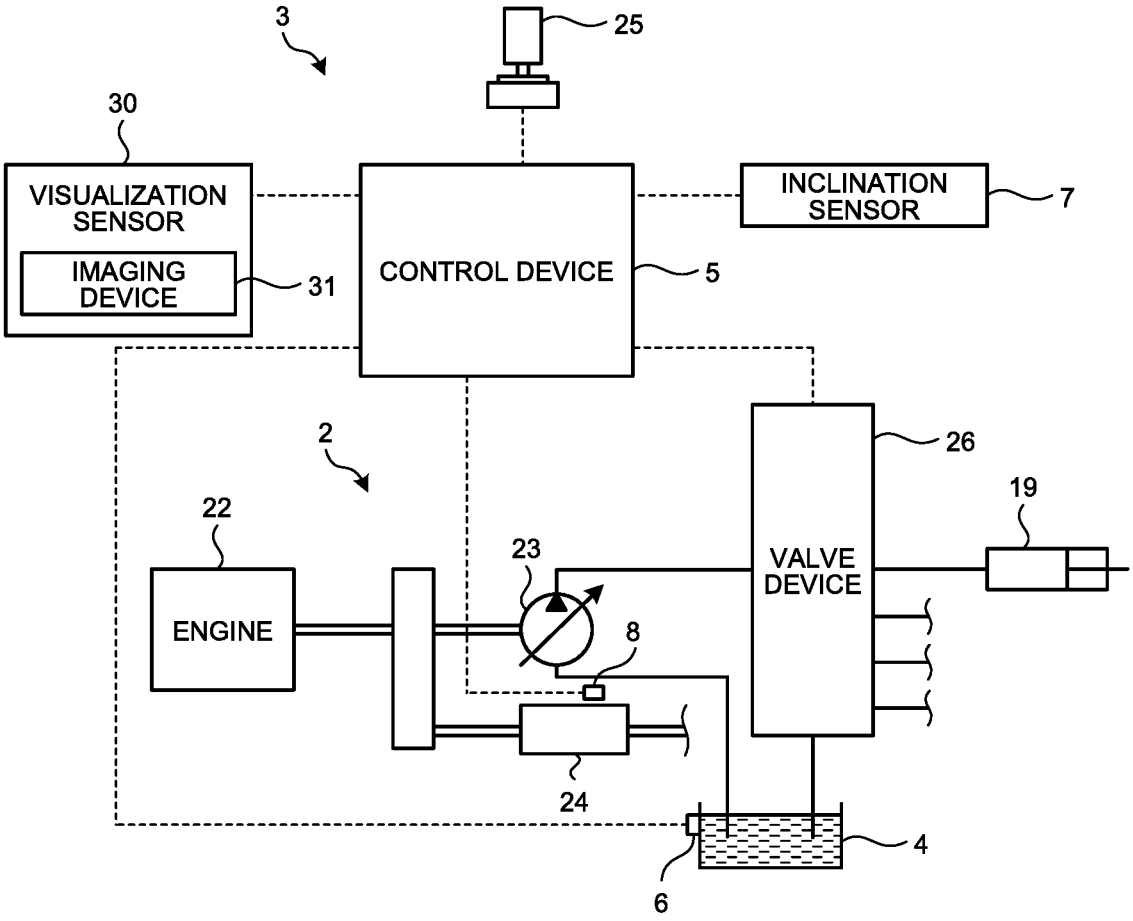
FIG. 2 is a block diagram illustrating a driving system and a control system of the work vehicle according to the embodiment.

FIG. 2 is a block diagram illustrating a driving system 2 and a control system 3 of the work vehicle 1 according to this embodiment. As illustrated in FIG. 2, the driving system 2 includes an engine 22, a hydraulic pump 23, and a power transmission device 24.

The hydraulic pump 23 is driven by the engine 22. The hydraulic pump 23 sucks and discharges hydraulic oil stored in a hydraulic oil tank 4. The hydraulic oil discharged from the hydraulic pump 23 is supplied to the lift cylinder 19 and the like. Note that, in FIG. 2, one hydraulic pump 23 is illustrated. However, a plurality of hydraulic pumps may be provided.

The power transmission device 24 transmits a driving force of the engine 22 to the traveling equipment 12. The power transmission device 24 may be, for example, an HST (Hydro Static Transmission). The power transmission device 24 may be, for example, a transmission including a torque converter or a plurality of change gears.

The control system 3 includes a control device 5, an operation device 25, and a valve device 26. The operation device 25 is disposed in the driver's cab 14. As the operation device 25, at least one of an operation lever, a pedal, and a switch is illustrated. The operation device 25 is operated by a driver in order to drive the working equipment 13 and the traveling equipment 12. When the operation device 25 is operated, an operation signal is output from the operation device 25 to the control device 5.

The valve device 26 includes a proportional control valve and is controlled by a control command from the control device 5. The valve device 26 is disposed between the lift cylinder 19 and the hydraulic pump 23. The valve device 26 controls a flow rate and a direction of the hydraulic oil supplied from the hydraulic pump 23 to the lift cylinder 19. Note that the valve device 26 may include a pressure proportional control valve or may include an electromagnetic control valve.

The control device 5 outputs, based on the operation signal from the operation device 25, control commands for controlling the working equipment 13, the traveling equipment 12, and the valve device 26. The control device 5 outputs, based on the operation signal from the operation device 25, a control command to the valve device 26 such that the blade 18 operates. Consequently, the lift cylinder 19 operates based on an operation amount of the operation device 25.

The control system 3 includes a state quantity sensor that detects a state quantity relating to the hydraulic oil tank 4. State quantity data indicating the state quantity relating to the hydraulic oil tank 4 includes at least one of oil quantity data indicating the quantity of the hydraulic oil stored in the hydraulic oil tank 4, inclination data indicating an inclination angle of the hydraulic oil tank 4, and acceleration data indicating acceleration of the hydraulic oil tank 4. As illustrated in FIG. 1, the hydraulic oil tank 4 is disposed in the vehicle body 11. The hydraulic oil tank 4 is disposed behind the driver's cab 14.

The state quantity sensor includes an oil quantity sensor 6 that detects the quantity of the hydraulic oil stored in the hydraulic oil tank 4, an inclination sensor 7 that detects an inclination angle of the vehicle body 11 with respect to a horizontal plane, and an acceleration sensor 8 that detects acceleration of the traveling equipment 12.

The oil quantity sensor 6 is provided in the hydraulic oil tank 4 and detects the quantity of the hydraulic oil stored in the hydraulic oil tank 4. Oil quantity data indicating the quantity of the hydraulic oil detected by the oil quantity sensor 6 is output to the control device 5.

The inclination sensor 7 includes an inertial measurement unit (IMU) provided in the vehicle body 11. The inclination sensor 7 detects an inclination angle of the vehicle body 11 with respect to the horizontal plane. The hydraulic oil tank 4 is provided in the vehicle body 11. The inclination angle of the vehicle body 11 includes an inclination angle of the hydraulic oil tank 4. The inclination sensor 7 can detect an inclination angle of the hydraulic oil tank 4 with respect to the horizontal plane. Inclination data indicating the inclination angle of the hydraulic oil tank 4 detected by the inclination sensor 7 is output to the control device 5.

The acceleration sensor 8 is provided in the power transmission device 24 and detects acceleration of the traveling equipment 12 (the vehicle body 11). When the power transmission device 24 is an HST including a hydraulic motor, the acceleration sensor 8 may be a rotation sensor that detects output rotation speed of the hydraulic motor. The output rotation speed is subjected to differential processing, whereby output rotation acceleration is calculated. The output rotation acceleration and the acceleration of the traveling equipment 12 correspond in a one-to-one relation. Accordingly, the acceleration sensor 8 can detect the acceleration of the traveling equipment 12 by detecting the output rotation speed. The vehicle body 11, in which the hydraulic oil tank 4 is provided, is supported by the traveling equipment 12. The acceleration of the traveling equipment 12 (the vehicle body 11) includes acceleration of the hydraulic oil tank 4. The acceleration sensor 8 can detect acceleration of the hydraulic oil tank 4. Acceleration data indicating the acceleration of the hydraulic oil tank 4 detected by the acceleration sensor 8 is output to the control device 5. Note that the IMU may detect the acceleration of the vehicle body 11 and the hydraulic oil tank 4.

[Hydraulic Oil Tank]

Figure 3:
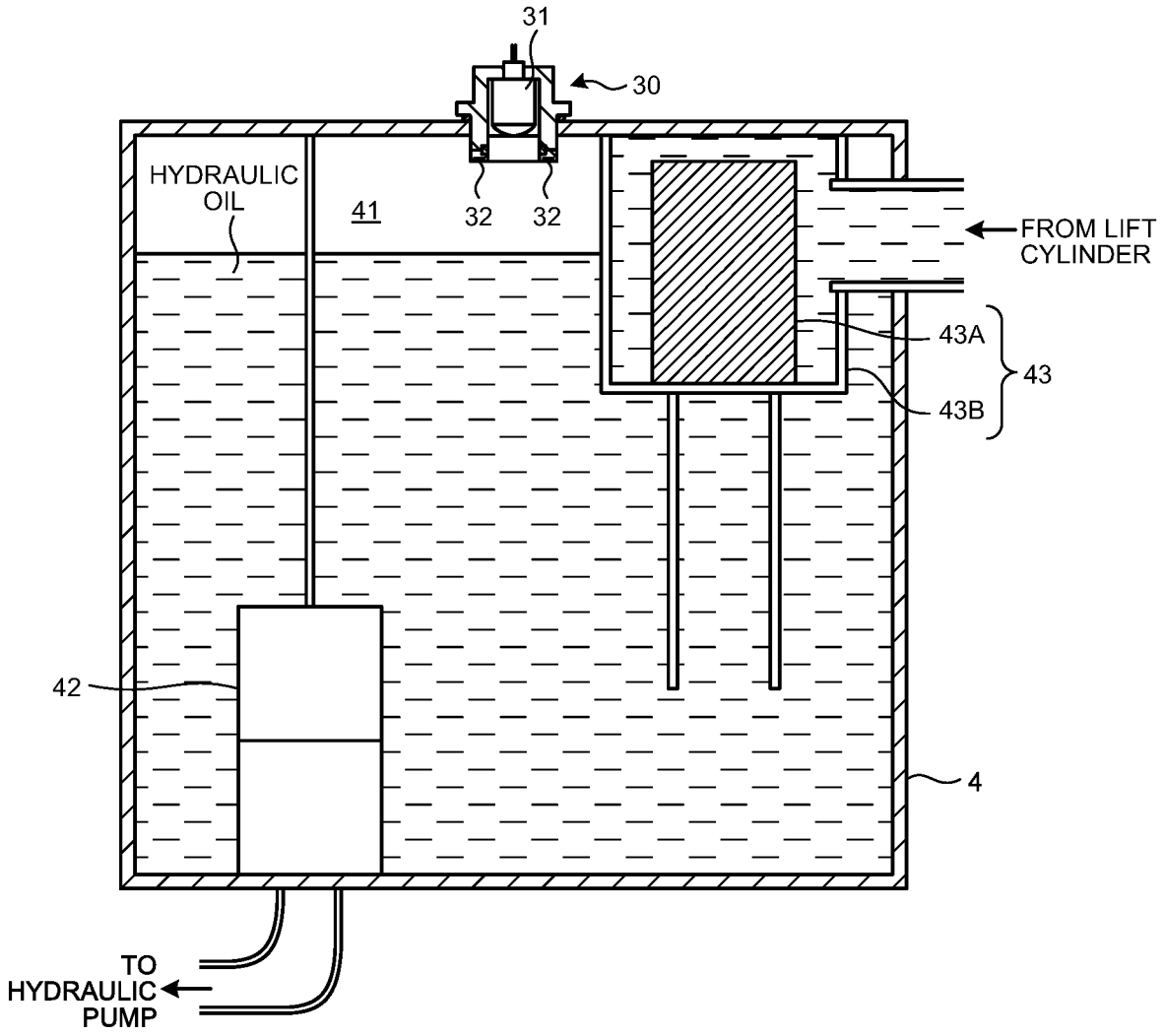
FIG. 3 is a diagram illustrating an example of a hydraulic oil tank according to the embodiment.

FIG. 3 is a diagram illustrating an example of the hydraulic oil tank 4 according to this embodiment. The hydraulic oil is stored in an internal space 41 of the hydraulic oil tank 4. The hydraulic oil tank 4 includes a strainer 42 disposed in the internal space 41 and a filter unit 43 disposed in the internal space 41. The filter unit 43 includes a filter main body 43A and a filter case 43B disposed around the filter main body 43A. The hydraulic oil in the internal space 41 is supplied to the hydraulic pump 23 via the strainer 42. The hydraulic oil from the lift cylinder 19 is supplied to the internal space 41 via the filter unit 43.

In this embodiment, a visualization sensor 30 is disposed in the hydraulic oil tank 4. The visualization sensor 30 means a sensor that includes at least an imaging device 31 and visualizes a detection target and detects the detection target. That is, the visualization sensor 30 means a sensor that acquires image data of the detection target and detects the detection target. The visualization sensor 30 is supported by an upper plate of the hydraulic oil tank 4. The visualization sensor 30 images the hydraulic oil from above the oil surface of the hydraulic oil stored in the hydraulic oil tank 4

The visualization sensor 30 includes an illuminating device 32. The illuminating device 32 illuminates the hydraulic oil, which is a subject of the imaging device 31. The imaging device 31 images the hydraulic oil illuminated by the illuminating device 32. Note that the illuminating device 32 may be separate from the visualization sensor 30. The illuminating device 32 only has to be disposed in the hydraulic oil tank 4 to illuminate the hydraulic oil, which is the subject of the imaging device 31.

[Monitoring System]

Next, a monitoring system 100 for hydraulic oil according to this embodiment is explained. The monitoring system 100 monitors, via the visualization sensor 30, a state of the hydraulic oil stored in the hydraulic oil tank 4. The monitoring system 100 analyzes air bubbles included in the hydraulic oil based on image data acquired by the imaging device 31 of the visualization sensor 30.

Figure 4:
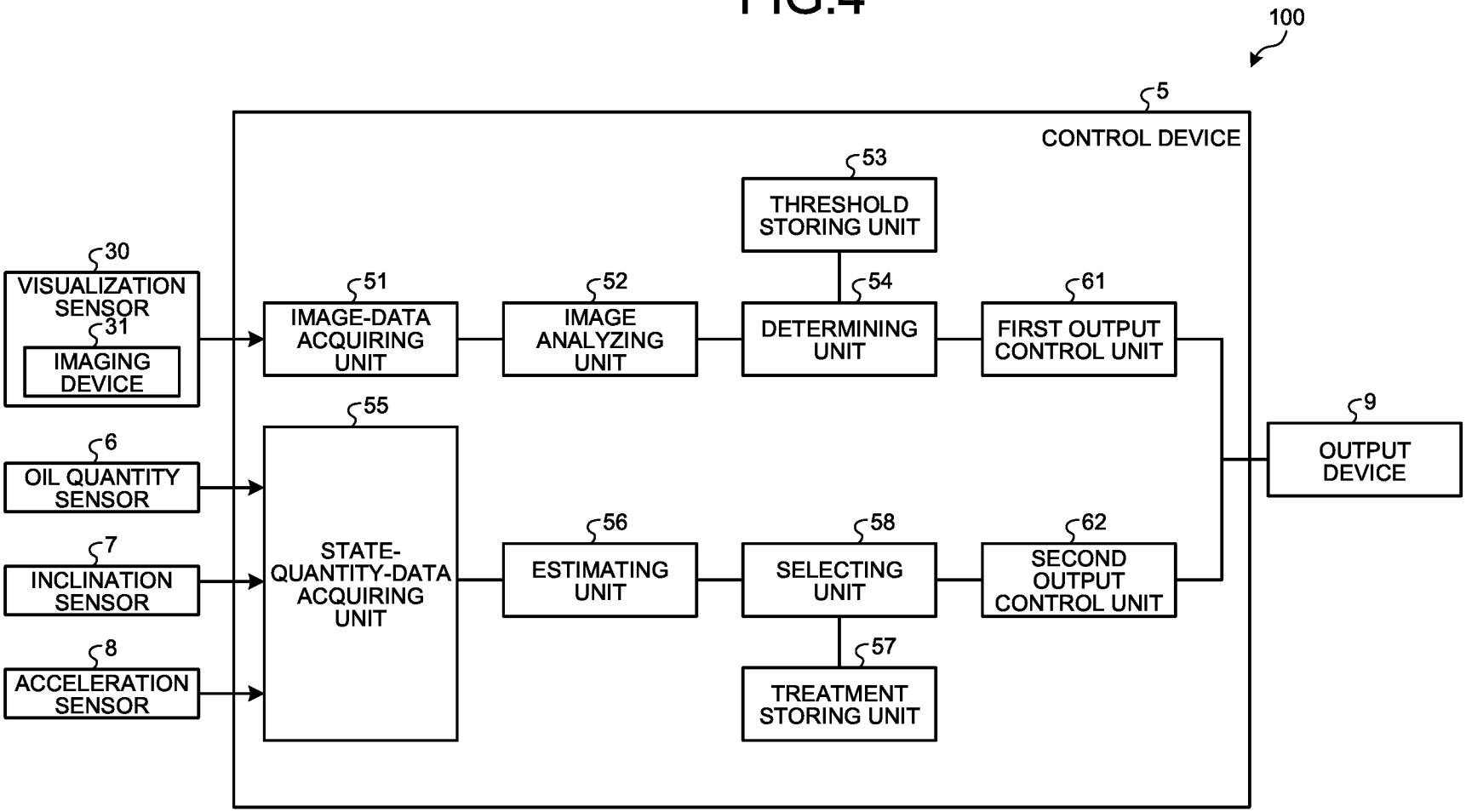
FIG. 4 is a functional block diagram illustrating an example of a monitoring system according to the embodiment.

FIG. 4 is a functional block diagram illustrating an example of the monitoring system 100 according to this embodiment. The monitoring system 100 includes the control device 5 mounted on the work vehicle 1, the visualization sensor 30, the oil quantity sensor 6, the inclination sensor 7, the acceleration sensor 8, and an output device 9 provided in the driver's cab 14 of the work vehicle 1. The control device 5 includes a computer system.

The output device 9 is connected to the control device 5. The output device 9 may be a display device that outputs display data, may be a printing device that outputs a print, or may be a sound output device that outputs sound. As the display device, a flat panel display such as a liquid crystal display (LCD) or an organic electroluminescence display (OELD) is illustrated.

The control device 5 is connected to each of the visualization sensor 30, the oil quantity sensor 6, the inclination sensor 7, and the acceleration sensor 8. The imaging device 31 outputs image data of the oil surface of the hydraulic oil to the control device 5. The oil quantity sensor 6 outputs oil quantity data of the hydraulic oil tank 4 to the control device 5. The inclination sensor 7 outputs inclination data of the hydraulic oil tank 4 to the control device 5. The acceleration sensor 8 outputs acceleration data of the hydraulic oil tank 4 to the control device 5.

The control device 5 includes an image-data acquiring unit 51, an image analyzing unit 52, a threshold storing unit 53, a determining unit 54, a state-quantity-data acquiring unit 55, an estimating unit 56, a treatment storing unit 57, a selecting unit 58, a first output control unit 61, and a second output control unit 62.

The image-data acquiring unit 51 acquires, from the imaging device 31 of the visualization sensor 30, the image data of the oil surface of the hydraulic oil stored in the hydraulic oil tank 4 of the work vehicle 1.

The image analyzing unit 52 outputs, based on the image data acquired by the image-data acquiring unit 51, air bubble data relating to air bubbles included in the hydraulic oil. That is, the image analyzing unit 52 performs image processing of the image data and extracts the air bubbles included in the hydraulic oil. The image analyzing unit 52 outputs, as the air bubble data, at least one of the quantity of the air bubbles and the size of the air bubbles on the oil surface of the hydraulic oil. Note that image analysis and diagnosis may be performed by a human or may be automatically performed using artificial intelligence (AI) or the like.

The oil surface of the hydraulic oil is disposed in a visual field region of an optical system of the imaging device 31. The visual field region of the optical system of the imaging device 31 is smaller than the oil surface of the hydraulic oil stored in the hydraulic oil tank 4. The quantity of the air bubbles on the oil surface of the hydraulic oil is specified by a ratio of the air bubbles to the oil surface of the hydraulic oil in the image data. The size of the air bubbles is specified by the area of one air bubble in the image data.

The threshold storing unit 53 stores threshold data indicating an air bubble threshold relating to the air bubble data. The air bubble threshold includes an air bubble quantity threshold relating to the quantity of the air bubbles and an air bubble dimension threshold relating to the size of the air bubbles.

The determining unit 54 determines, based on the air bubble data output from the image analyzing unit 52 and the threshold data stored in the threshold storing unit 53, whether the hydraulic oil is abnormal and outputs determination data. For example, when the quantity of the air bubbles is equal to or larger than the air bubble quantity threshold, the determining unit 54 determines that a large quantity of air bubbles occur in the hydraulic oil and the hydraulic oil is abnormal.

The first output control unit 61 causes the output device 9 to output at least one of the image data acquired by the image-data acquiring unit 51, the air bubble data output from the image analyzing unit 52, and the determination data by the determining unit 54.

The state-quantity-data acquiring unit 55 acquires state quantity data relating to the hydraulic oil tank 4 from each of the oil quantity sensor 6, the inclination sensor 7, and the acceleration sensor 8. As explained above, the state quantity data includes at least one of the oil quantity data indicating the quantity of the hydraulic oil stored in the hydraulic oil tank 4, the inclination data indicating the inclination angle of the hydraulic oil tank 4, and the acceleration data indicating the acceleration of the hydraulic oil tank 4.

The estimating unit 56 estimates a cause of the occurrence of the air bubbles based on the state quantity data acquired by the state-quantity-data acquiring unit 55.

The treatment storing unit 57 stores a plurality of treatment data indicating treatment methods for suppressing occurrence of air bubbles. The treatment methods for suppressing occurrence of air bubbles are patterned and can be registered in the treatment storing unit 57 beforehand.

The selecting unit 58 selects, based on the estimation data by the estimating unit 56, specific treatment data from the plurality of treatment data.

The second output control unit 62 causes the output device 9 to output the treatment data selected by the selecting unit 58.

[Processing by the Determining Unit]

Figure 5:
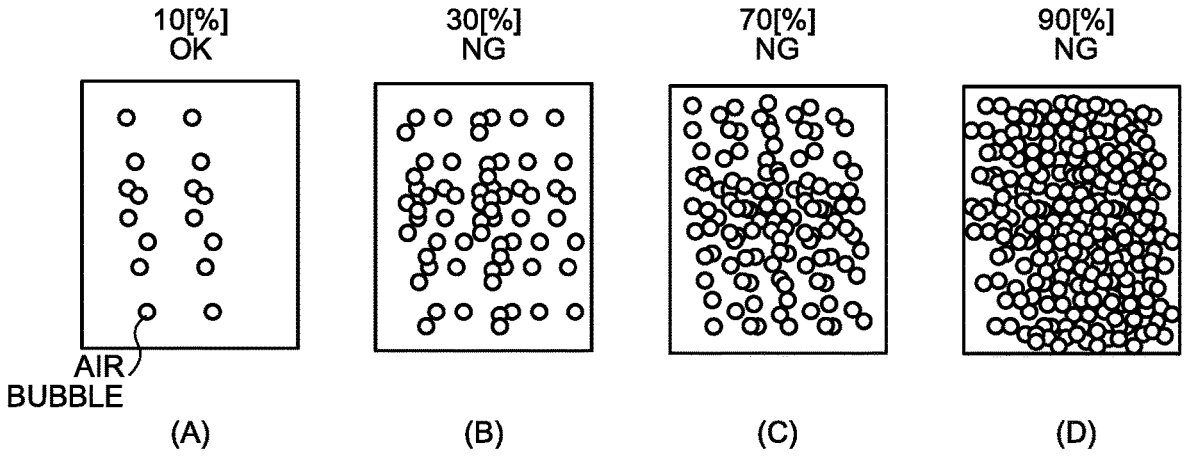
FIG. 5 is a schematic diagram for explaining processing by a determining unit according to the embodiment.

Next, processing by the determining unit 54 is explained. FIG. 5 is a schematic diagram for explaining the processing by the determining unit 54 according to this embodiment. As illustrated in FIG. 5, the image analyzing unit 52 analyzes the image data of the oil surface of the hydraulic oil and extracts an image of the air bubbles from the image data. The image analyzing unit 52 calculates a ratio of the air bubbles in the image data.

In an example illustrated in FIG. 5(A), the air bubbles are 10[%]. In an example illustrated in FIG. 5(B), the air bubbles are 30[%]. In an example illustrated in FIG. 5(C), the air bubbles are 70[%]. In an example illustrated in FIG. 5(D), the air bubbles are 90[%]. In this embodiment, the air bubble threshold relating to the air bubbles stored in the threshold storing unit 53 is 30[%]. As illustrated in FIG. 5(A), when the air bubbles are 10[%], the determining unit 54 determines that the hydraulic oil is normal. As illustrated in FIG. 5(B), FIG. 5(C), and FIG. 5(D), when the air bubbles are 30[%] or more, the determining unit 54 determines that the hydraulic oil is abnormal. When determining that the hydraulic oil is normal, the determining unit 54 outputs determination data indicating that the hydraulic oil is normal. When determining that the hydraulic oil is abnormal, the determining unit 54 outputs abnormality data indicating that the hydraulic oil is abnormal. Note that the determination of the quantity of the air bubbles may be quantitative determination for determining that the air bubbles are many or few.

The first output control unit 61 causes the output device 9 to output the determination data. Consequently, an operator or a maintenance person of the work vehicle 1 can take appropriate measures looking at the determination data output from the output device 9.

In this embodiment, when the quantity of the air bubbles is smaller than a first air bubble threshold (for example, smaller than 5[%]), the first output control unit 61 does not cause the output device 9 to output the determination data. Note that the control device 5 may notify an agent or the maintenance person via a communication network that the quantity of the air bubbles is smaller than the first air bubble threshold.

When the quantity of the air bubbles is equal to or larger than the first air bubble threshold and smaller than a second air bubble threshold (for example, equal to or larger than 5[%] and smaller than 30[%]), the first output control unit 61 causes the output device 9 to output the determination data. Consequently, the driver can recognize that the quantity of the air bubbles has become large. Note that the control device 5 may notify the agent or the maintenance person via the communication network that the quantity of the air bubbles is equal to or larger than the first air bubble threshold and smaller than the second air bubble threshold.

When the quantity of the air bubbles is equal to or larger than the second air bubble threshold (for example, equal to or larger than 30[%]), the first output control unit 61 causes the output device 9 to output the determination data. Consequently, the driver can recognize that the quantity of the air bubbles has become extremely large. The control device 5 notifies a not-illustrated engine control device that the quantity of the air bubbles has become equal to or larger than the second air bubble threshold. The engine control device can limit the engine speed of the engine 22 or restrict the start of the engine 22. Note that the control device 5 may notify the agent or the maintenance person via the communication network that the quantity of the air bubbles is equal to or larger than the second air bubble threshold. The control device 5 may notify a factory, which performs manufacturing or maintenance and inspection of the work vehicle 1, that the quantity of the air bubbles is equal to or larger than the second air bubble threshold.

[Processing by the Selecting Unit]

Figure 6:
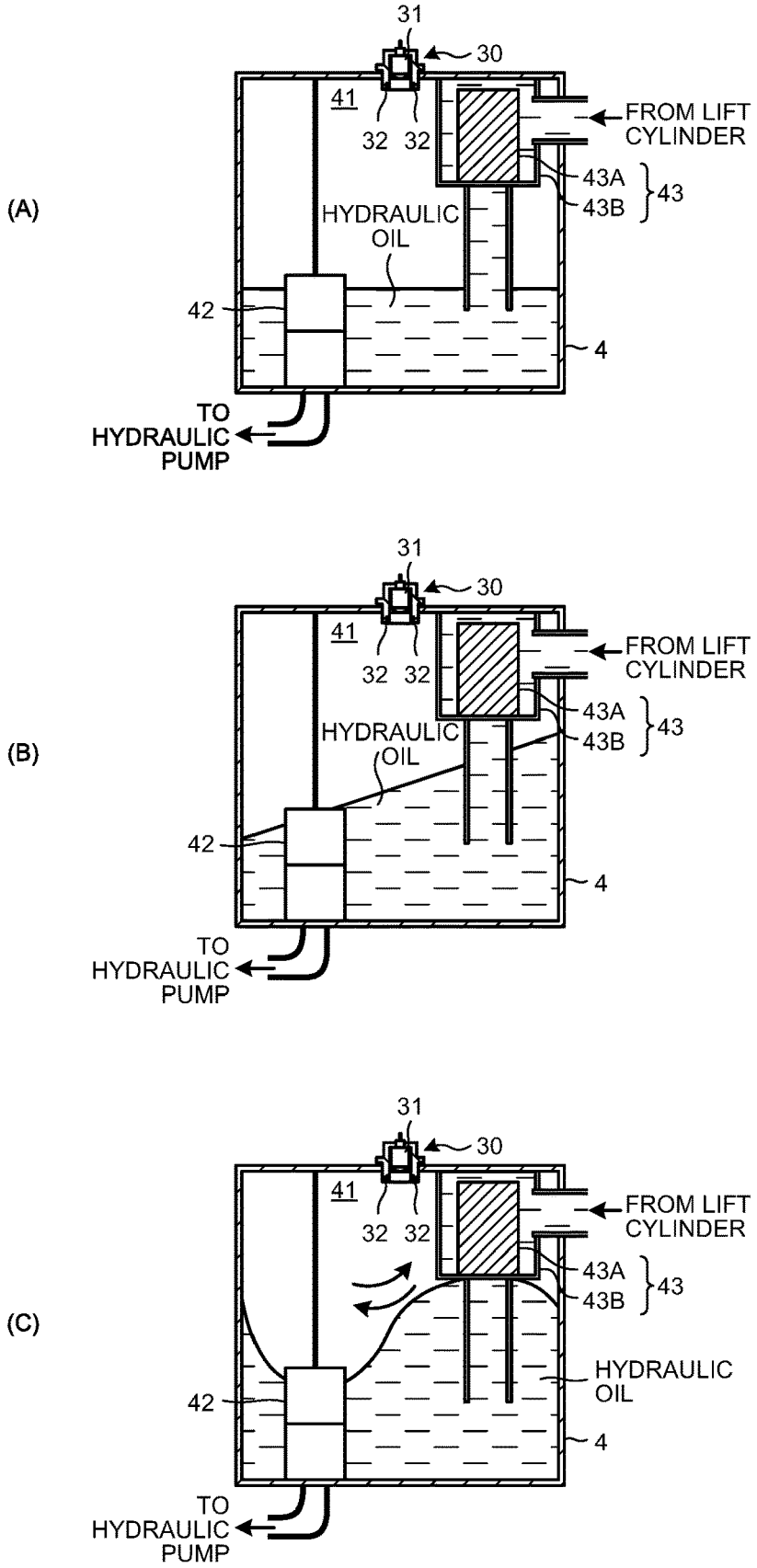
FIG. 6 is a schematic diagram for explaining a cause of occurrence of air bubbles according to the embodiment.

Next, processing by the selecting unit 58 is explained. FIG. 6 is a schematic diagram for explaining a cause of the occurrence of the air bubbles according to this embodiment. As explained above, the hydraulic oil returning from the lift cylinder 19 is returned to the hydraulic oil tank 4 via the filter unit 43. A cause of the occurrence of the air bubbles is patterned.

As a first pattern of the cause of the occurrence of the air bubbles, a decrease in the quantity of the hydraulic oil in the hydraulic oil tank 4 is cited. As illustrated in FIG. 6(A), when the quantity of the hydraulic oil in the hydraulic oil tank 4 decreases and at least a part of the strainer 42 comes into contact with the air, the hydraulic pump 23 sucks the hydraulic oil together with the air.

As a second pattern of the cause of the occurrence of the air bubbles, inclination of the hydraulic oil tank 4 is cited. As illustrated in FIG. 6(B), when the hydraulic oil tank 4 inclines because the posture of the work vehicle 1 tilts because of a slope or the like, the oil surface of the hydraulic oil also tilts, the upper end portion of the strainer 42 protrudes from the oil surface, and the hydraulic pump 23 sucks the hydraulic oil together with the air.

As a third pattern of the cause of the occurrence of the air bubbles, sudden acceleration of the hydraulic oil tank 4 is cited. As illustrated in FIG. 6(C), when the driver suddenly accelerates the work vehicle 1 and the hydraulic oil tank 4 suddenly accelerates, the oil surface of the hydraulic oil undulates and engulfs the air. Therefore, likelihood of the occurrence of the air bubbles in the hydraulic oil increases. The upper end portion of the strainer 42 protrudes from the oil surface because of oil surface fluctuation and sucks the hydraulic oil together with the air.

Although not illustrated, as a fourth pattern of the cause of the occurrence of the air bubbles, breakage of the filter case 43B is cited. When the filter case 43B is broken, the air intrudes into the hydraulic oil from a broken portion. The likelihood of the occurrence of the air bubbles in the hydraulic oil increases.

When the air bubbles occur in the hydraulic oil and oil quantity data indicating that the quantity of the hydraulic oil in the hydraulic oil tank 4 detected by the oil quantity sensor 6 is equal to or smaller than an oil quantity threshold is acquired by the state-quantity-data acquiring unit 55, the estimating unit 56 estimates, based on the oil quantity data, that the cause of the occurrence of the air bubbles is the decrease in the quantity of the hydraulic oil, which is the first pattern.

When the air bubbles occur in the hydraulic oil and inclination data indicating that the inclination angle of the hydraulic oil tank 4 is equal to or larger than an inclination angle threshold or a change rate of the inclination angle is equal to or larger than a change rate threshold is acquired by the state-quantity-data acquiring unit 55, the estimating unit 56 estimates, based on the inclination data, that the cause of the occurrence of the air bubbles is the inclination of the hydraulic oil tank 4, which is the second pattern. Note that the change rate of the inclination angle means a change amount of the inclination angle per unit time. A larger change rate indicates that the hydraulic oil tank 4 more suddenly inclines. Note that the estimating unit 56 is also capable of estimating the cause of the occurrence of the air bubbles using both of the inclination angle and the change rate of the inclination angle.

When the air bubbles occur in the hydraulic oil and acceleration data indicating that the acceleration of the hydraulic oil tank 4 is equal to or larger than an acceleration threshold is acquired by the state-quantity-data acquiring unit 55, the estimating unit 56 estimates, based on the acceleration data, that the cause of the occurrence of the air bubbles is the acceleration of the hydraulic oil tank 4, which is the third pattern.

When the air bubbles occur in the hydraulic oil and the cause of the occurrence of the air bubbles does not correspond to all of the first pattern in which the quantity of the hydraulic oil is equal to or smaller than the oil quantity threshold, the second pattern in which the inclination angle of the hydraulic oil tank 4 is equal to or larger than the inclination angle threshold or the change rate of the inclination angle is equal to or larger than the change rate threshold, and the third pattern in which the acceleration of the hydraulic oil tank 4 is equal to or larger than the acceleration threshold, the estimating unit 56 estimates that the cause of the occurrence of the air bubbles is breakage of the filter case 43B, which is the fourth pattern.

The treatment storing unit 57 stores a plurality of treatment data indicating treatment methods for suppressing occurrence of air bubbles. The treatment methods for suppressing occurrence of air bubbles are patterned and registered in the treatment storing unit 57 beforehand.

[Treatment Storing Unit]

FIG. 7 is a schematic diagram illustrating an example of the treatment storing unit 57 according to this embodiment. As illustrated in FIG. 7, the treatment methods are registered to correspond to causes of the occurrence of the air bubbles.

In the treatment storing unit 57, first treatment data corresponding to the first pattern of the cause of the occurrence of the air bubbles is registered. That is, as first treatment data indicating a first treatment method at the time when the quantity of the hydraulic oil in the hydraulic oil tank 4 is equal to or smaller than the oil quantity threshold, "supply oil to the hydraulic oil tank" is registered in the treatment storing unit 57.

In the treatment storing unit 57, second treatment data corresponding to the second pattern of the cause of the occurrence of the air bubbles is registered. That is, second treatment data indicating a second treatment method at the time when the inclination angle of the hydraulic oil tank 4 is equal to or larger than the inclination angle threshold or the change rate of the inclination angle is equal to or larger than the change rate threshold, "not use the work vehicle in a place where inclination is large" is registered in the treatment storing unit 57.

In the treatment storing unit 57, third treatment data corresponding to the third pattern of the cause of the occurrence of the air bubbles is registered. That is, as third treatment data indicating a third treatment method at the time when the acceleration of the hydraulic oil tank 4 is equal to or larger than the acceleration threshold, "reduce acceleration" is registered in the treatment storing unit 57.

In the treatment storing unit 57, fourth treatment data corresponding to the fourth pattern of the cause of the occurrence of the air bubbles is registered. That is, as fourth treatment data indicating a fourth treatment method at the time when the hydraulic oil tank 4 is broken, "repair the hydraulic oil tank or replace components" is registered in the treatment storing unit 57.

The selecting unit 58 selects, based on the estimation data by the estimating unit 56, specific treatment data from the plurality of treatment data stored in the treatment storing unit 57.

For example, when the estimating unit 56 estimates that the cause of the occurrence of the air bubbles is the decrease in the quantity of the hydraulic oil, the selecting unit 58 selects, as the treatment data, "supply oil to the hydraulic oil tank", which is the first treatment data.

When the estimating unit 56 estimates that the cause of the occurrence of the air bubbles is the inclination of the hydraulic oil tank 4, the selecting unit 58 selects, as the treatment data, "not use the work vehicle in a place where inclination is large", which is the second treatment data.

When the estimating unit 56 estimates that the cause of the occurrence of the air bubbles is the acceleration of the hydraulic oil tank 4, the selecting unit 58 selects, as the treatment data, "reduce acceleration", which is the third treatment data.

When the estimating unit 56 estimates that the cause of the occurrence of the air bubbles is breakage of the hydraulic oil tank 4, the selecting unit 58 selects, as the treatment data, "repair the hydraulic oil tank or replace components", which is the fourth treatment data.

The second output control unit 62 causes the output device 9 to output the treatment data selected by the selecting unit 58. For example, "supply oil to the hydraulic oil tank", which is the first treatment data, is output by the output device 9, whereby the driver or the maintenance person can supply the hydraulic oil to the hydraulic oil tank 4. "Not use the work vehicle in a place where inclination is large", which is the second treatment data, is output by the output device 9, whereby the driver can operate the operation device 25 such that the work vehicle 1 travels in a place where inclination is small. "Reduce acceleration", which is the third treatment data, is output by the output device 9, whereby the driver can operate the operation device 25 not to suddenly accelerate the work vehicle 1. "Repair the hydraulic oil tank or replace components", which is the fourth treatment data, is output by the output device 9, whereby the driver or the maintenance person of the work vehicle 1 can repair the hydraulic oil tank 4 or replace components.

[Monitoring Method for Hydraulic Oil]

FIG. 8 is a flowchart illustrating an example of a hydraulic oil monitoring method according to this embodiment. The visualization sensor 30 always monitors a state of the oil surface of the hydraulic oil in the hydraulic oil tank 4. The imaging device 31 images the hydraulic oil from above the oil surface of the hydraulic oil. The imaging device 31 images the hydraulic oil illuminated by the illuminating device 32. Image data acquired by the imaging device 31 is output to the control device 5 at a specified cycle. The image-data acquiring unit 51 acquires the image data from the imaging device 31 (Step SA10).

The image analyzing unit 52 analyzes the image data acquired by the image-data acquiring unit 51 (step SA20).

The image analyzing unit 52 outputs, based on the image data, air bubble data relating to air bubbles included in the hydraulic oil (Step SA30). The image analyzing unit 52 outputs, as the air bubble data, at least one of the quantity of the air bubbles and the size of the air bubbles.

The determining unit 54 determines, based on the air bubble data output from the image analyzing unit 52 and the threshold data stored in the threshold storing unit 53, whether the air bubbles are equal to or more than an air bubble threshold (Step SA40). The determining unit 54 determines whether, for example, a ratio of the air bubbles in the image data is equal to or larger than the air bubble threshold (equal to or larger than 30[%]).

When it is determined in Step SA40 that the air bubbles are not equal to or more than the air bubble threshold (Step SA40: No), the determining unit 54 determines that the hydraulic oil is normal and returns to the processing in Step SA10.

When it is determined in Step SA40 that the air bubbles are equal to or more than the air bubble threshold (Step SA40: Yes), the determining unit 54 determines that the hydraulic oil is abnormal. The first output control unit 61 causes the output device 9 to output determination data indicating that the hydraulic oil is abnormal (Step SA50).

[Treatment Method]

Figure 9:
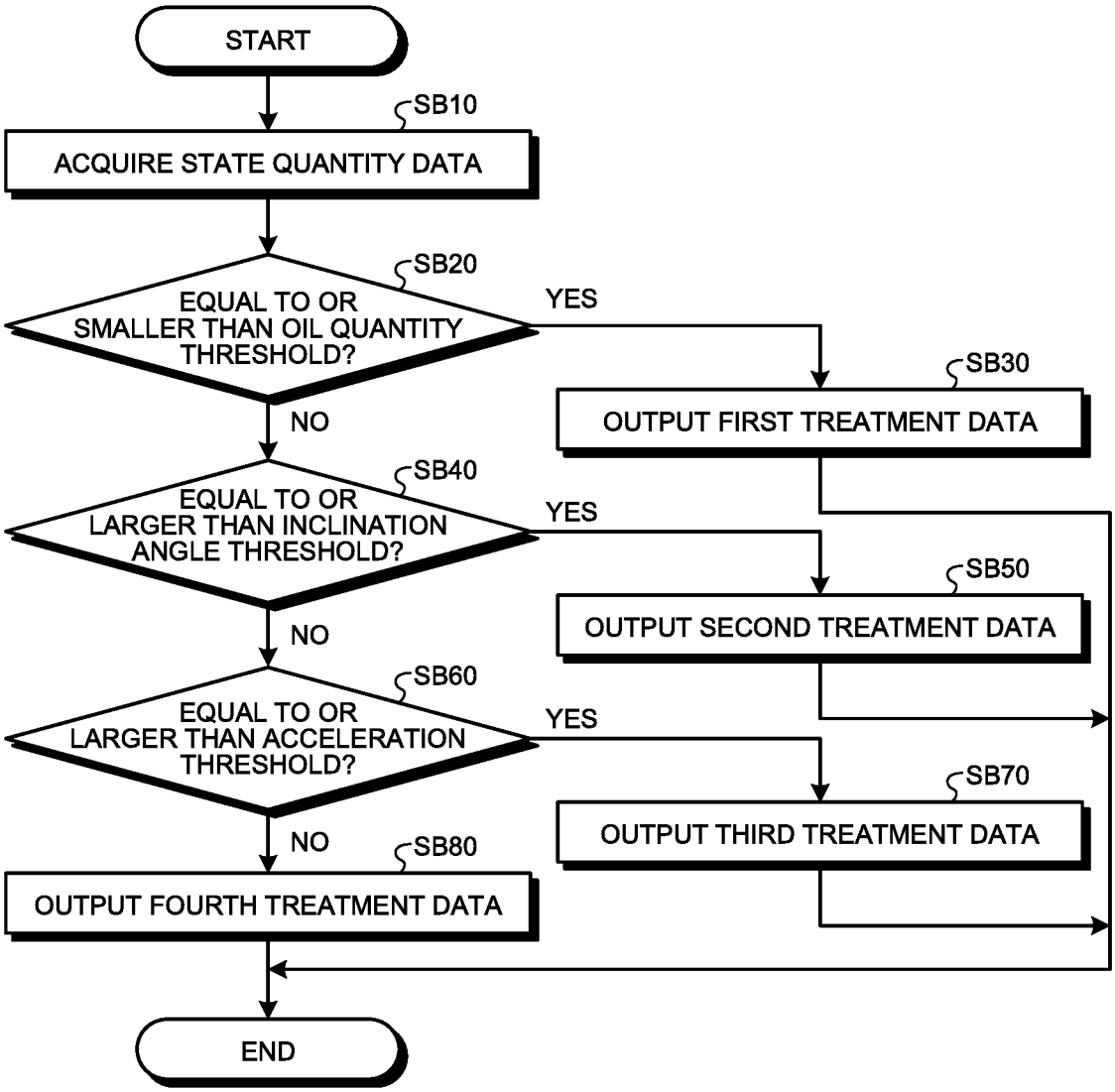
FIG. 9 is a flowchart illustrating an example of a treatment method according to the embodiment.

Next, a treatment method for suppressing occurrence of air bubbles at the time when it is determined by the determining unit 54 that the air bubbles occur in the monitoring method explained with reference to FIG. 8 is explained. FIG. 9 is a flowchart illustrating an example of a treatment method according to this embodiment.

The state-quantity-data acquiring unit 55 acquires oil quantity data from the oil quantity sensor 6 as a state quantity relating to the hydraulic oil tank 4, acquires inclination data from the inclination sensor 7, and acquires acceleration data from the acceleration sensor 8 (Step SB10).

The estimating unit 56 estimates a cause of the occurrence of the air bubbles based on state quantity data. The estimating unit 56 determines, based on the oil quantity data, whether the quantity of the hydraulic oil in the hydraulic oil tank 4 is equal to or smaller than the oil quantity threshold (Step SB20).

When determining in Step SB20 that the quantity of the hydraulic oil in the hydraulic oil tank 4 is equal to or smaller than the oil quantity threshold (Step SB20: Yes), the estimating unit 56 estimates that the cause of the occurrence of the air bubbles is the decrease in the quantity of the hydraulic oil, which is the first pattern. The selecting unit 58 selects the first treatment data from the plurality of treatment data stored in the treatment storing unit 57. The second output control unit 62 causes the output device 9 to output the first treatment data selected by the selecting unit 58 (Step SB30).

When determining in step SB20 that the quantity of the hydraulic oil in the hydraulic oil tank 4 is not equal to or smaller than the oil quantity threshold (step SB20: No), the estimating unit 56 determines, based on the inclination data, whether the inclination angle of the hydraulic oil tank 4 is equal to or larger than the inclination angle threshold (step SB40).

When determining in Step SB40 that the inclination angle of the hydraulic oil tank 4 is equal to or larger than the inclination angle threshold (Step SB40: Yes), the estimating unit 56 estimates that the cause of the occurrence of the air bubbles is the inclination of the hydraulic oil tank 4, which is the second pattern. The selecting unit 58 selects the second treatment data from the plurality of treatment data stored in the treatment storing unit 57. The second output control unit 62 causes the output device 9 to output the second treatment data selected by the selecting unit 58 (Step SB50).

When determining in Step SB40 that the inclination angle of the hydraulic oil tank 4 is not equal to or larger than the inclination angle threshold (Step SB40: No), the estimating unit 56 determines, based on the acceleration data, whether the acceleration of the hydraulic oil tank 4 is equal to or larger than the acceleration threshold (Step SB60).

When determining in Step SB60 that the acceleration of the hydraulic oil tank 4 is equal to or larger than the acceleration threshold (Step SB60: Yes), the estimating unit 56 estimates that the cause of the occurrence of the air bubbles is the acceleration of the hydraulic oil tank 4, which is the third pattern. The selecting unit 58 selects the third treatment data from the plurality of treatment data stored in the treatment storing unit 57. The second output control unit 62 causes the output device 9 to output the third treatment data selected by the selecting unit 58 (Step SB70).

When determining in Step SB60 that the acceleration of the hydraulic oil tank 4 is not equal to or larger than the acceleration threshold (Step SB60: No), the estimating unit 56 estimates that the cause of the occurrence of the air bubbles is the breakage of the hydraulic oil tank 4, which is the fourth pattern. The selecting unit 58 selects the fifth treatment data from the plurality of treatment data stored in the treatment storing unit 57. The second output control unit 62 causes the output device 9 to output the fifth treatment data selected by the selecting unit 58 (Step SB80).

[Computer System]

Figure 10:
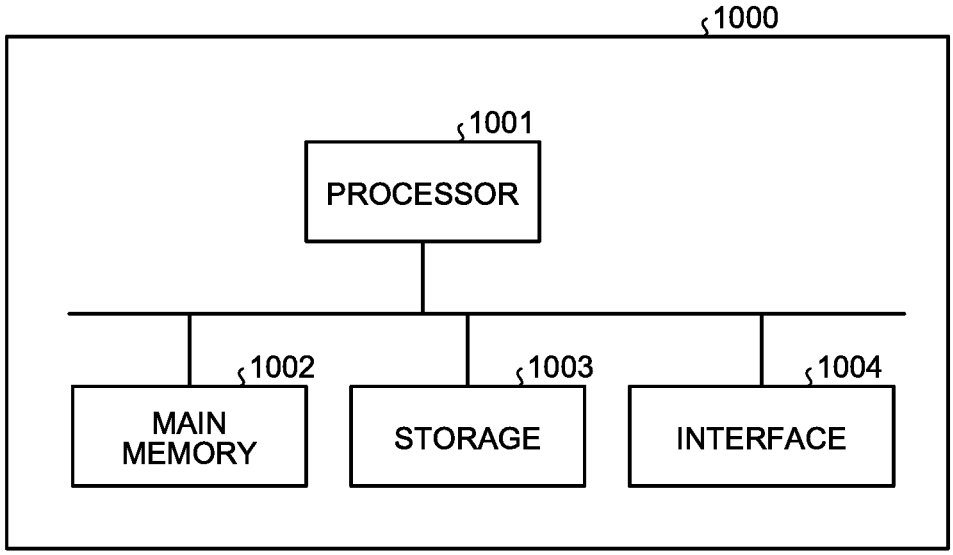
FIG. 10 is a block diagram illustrating an example of a computer system.

FIG. 10 is a block diagram illustrating an example of a computer system 1000. The control device 5 explained above includes the computer system 1000. The computer system 1000 includes a processor 1001 such as a CPU (Central Processing Unit), a main memory 1002 including a nonvolatile memory such as a ROM (Read Only Memory) and a volatile memory such as a RAM (Random Access Memory), a storage 1003, and an interface 1004 including an input and output circuit. The functions of the control device 5 explained above are stored in the storage 1003 as programs. The processor 1001 reads out the programs from the storage 1003, develops the programs on the main memory 1002, and executes the processing explained above according to the programs. Note that the programs may be distributed to the computer system 1000 via a network.

[Effects]

As explained above, according to this embodiment, the image-data acquiring unit 51 that acquires image data of the oil surface of the hydraulic oil stored in the hydraulic oil tank 4 of the work vehicle 1 and the image analyzing unit 52 that outputs, based on the image data, air bubble data relating to air bubbles included in the hydraulic oil are provided. Since the image data of the hydraulic oil is acquired, it is possible to quantitatively or qualitatively monitor the air bubbles included in the hydraulic oil. Consequently, it is possible to, for example, take measures for suppressing occurrence of air bubbles.

The image analyzing unit 52 can output, as the air bubble data, at least one of the quantity of the air bubbles and the size of the air bubbles.

The threshold data relating to the air bubble data is stored in the threshold storing unit 53 in advance, whereby the determining unit 54 can determine, based on the air bubble data and the threshold data, whether the hydraulic oil is abnormal.

At least one of the image data, the air bubble data, and the determination data of the hydraulic oil is output by the output device 9, whereby the driver or the maintenance person of the work vehicle 1 can recognize a state of the hydraulic oil through the visual sense or the auditory sense.

The state quantity data relating to the hydraulic oil tank 4 is acquired, whereby the estimating unit 56 can estimate a cause of the occurrence of the air bubbles based on the state quantity data.

A cause of the occurrence of the air bubbles is patterned. Accordingly, the treatment data indicating the treatment method for suppressing occurrence of air bubbles is stored in the treatment storing unit 57 in advance, whereby the selecting unit 58 can select, based on the estimation data by the estimating unit 56, treatment data corresponding to a pattern of a cause of the occurrence of the air bubbles. The treatment data selected by the selecting unit 58 is output by the output device 9, whereby the driver or the maintenance person can take, looking at the treatment data output by the output device 9, appropriate measures for suppressing occurrence of air bubbles.

The imaging device 31 disposed in the hydraulic oil tank 4 images the hydraulic oil from above the oil surface of the hydraulic oil. The air bubbles move to the oil surface of the hydraulic oil with buoyancy. Accordingly, the imaging device 31 images the hydraulic oil from above the upper surface of the hydraulic oil, whereby it is possible to acquire image data in which the presence of the air bubbles is seen.

The illuminating device 32 is disposed in the hydraulic oil tank 4, whereby, even if the internal space 41 of the hydraulic oil tank 4 is dark, the imaging device 31 can acquire the image data in which the presence of the air bubbles is seen.

Other Embodiments

In the embodiment explained above, an external computer system provided on the outside of the work vehicle 1 may include at least one function of the image-data acquiring unit 51, the image analyzing unit 52, the threshold storing unit 53, the determining unit 54, the state-quantity-data acquiring unit 55, the estimating unit 56, the treatment storing unit 57, and the selecting unit 58. In that case, the image data acquired by the imaging device 31 may be transmitted to the external computer system via a communication network. In the embodiment explained above, the output device 9 may be provided on the outside of the work vehicle 1.

REFERENCE SINGS LIST

1 WORK VEHICLE
2 DRIVING SYSTEM
3 CONTROL SYSTEM
4 HYDRAULIC OIL TANK
5 CONTROL DEVICE
6 OIL QUANTITY SENSOR
7 INCLINATION SENSOR
8 ACCELERATION SENSOR
9 OUTPUT DEVICE

11 VEHICLE BODY
12 TRAVELING EQUIPMENT
13 WORKING EQUIPMENT
14 DRIVER'S CAB
15 ENGINE COMPARTMENT
16 CRAWLER BELT
17 LIFT FRAME
18 BLADE
19 LIFT CYLINDER
22 ENGINE
23 HYDRAULIC PUMP
24 POWER TRANSMISSION DEVICE
25 OPERATION DEVICE
26 VALVE DEVICE
30 VISUALIZATION SENSOR
31 IMAGING DEVICE
32 ILLUMINATING DEVICE
41 INTERNAL SPACE
42 STRAINER
43 FILTER UNIT
43A FILTER MAIN BODY
43B FILTER CASE
51 IMAGE-DATA ACQUIRING UNIT
52 IMAGE ANALYZING UNIT
53 THRESHOLD STORING UNIT
54 DETERMINING UNIT
55 STATE-QUANTITY-DATA ACQUIRING UNIT
56 ESTIMATING UNIT
57 TREATMENT STORING UNIT
58 SELECTING UNIT
61 FIRST OUTPUT CONTROL UNIT
62 SECOND OUTPUT CONTROL UNIT
AX ROTATION AXIS

The invention claimed is:

1. A hydraulic oil monitoring system, comprising:
an image-data acquiring unit that acquires image data of an oil surface of hydraulic oil stored in a hydraulic oil tank of a work vehicle;
an image analyzing unit that outputs, based on the image data, air bubble data relating to air bubbles included in the hydraulic oil;
a state-quantity-data acquiring unit that acquires state quantity data relating to the hydraulic oil tank; and
an estimating unit that estimates a cause of occurrence of the air bubbles based on the state quantity data.

2. The hydraulic oil monitoring system according to claim 1, wherein
the image analyzing unit outputs, as the air bubble data, at least one of a quantity of the air bubbles and a size of the air bubbles.

3. The hydraulic oil monitoring system according to claim 1, further comprising:
a threshold storing unit that stores threshold data relating to the air bubble data; and
a determining unit that determines, based on the air bubble data output from the image analyzing unit and the threshold data, whether the hydraulic oil is abnormal and outputs determination data.

4. The hydraulic oil monitoring system according to claim 3, further comprising
a first output control unit that causes an output device to output at least one of the image data, the air bubble data, and the determination data.

5. The hydraulic oil monitoring system according to claim 1, wherein
the hydraulic oil tank is provided in a vehicle body of the work vehicle, and
the state quantity data includes at least one of oil quantity data indicating a quantity of the hydraulic oil stored in the hydraulic oil tank, inclination data indicating an inclination angle of the vehicle body, and acceleration data indicating acceleration of the vehicle body.

6. The hydraulic oil monitoring system according to claim 5, further comprising:
a treatment storing unit that stores treatment data indicating a treatment method for suppressing the occurrence of the air bubbles;
a selecting unit that selects specific treatment data based on estimation data by the estimating unit; and
a second output control unit that causes an output device to output the treatment data selected by the selecting unit.

7. The hydraulic oil monitoring system according to claim 1, wherein
an imaging device is disposed in the hydraulic oil tank,
the imaging device images the hydraulic oil from above the oil surface of the hydraulic oil, and
the image-data acquiring unit acquires the image data from the imaging device.

8. The hydraulic oil monitoring system according to claim 7, wherein
an illuminating device is disposed in the hydraulic oil tank, and
the imaging device images the hydraulic oil illuminated by the illuminating device.

9. A hydraulic oil monitoring method, comprising:
acquiring image data of an oil surface of hydraulic oil stored in a hydraulic oil tank of a work vehicle;
outputting, based on the image data, air bubble data relating to air bubbles included in the hydraulic oil;
acquiring state quantity data relating to the hydraulic oil tank; and
estimating a cause of occurrence of the air bubbles based on the state quantity data.

* * * * *